US006978998B2

(12) United States Patent
Zheng

(10) Patent No.: US 6,978,998 B2
(45) Date of Patent: Dec. 27, 2005

(54) POSITIONING STRUCTURE OF ROLLER ADAPTED FOR AN AUTO DOCUMENT FEED APPARATUS

(75) Inventor: Nanjun Zheng, Shuang-Pai Hsien (CN)

(73) Assignee: Lite-On Technology Corporation, Taipei (TW)

( * ) Notice: Subject to any disclaimer, the term of this patent is extended or adjusted under 35 U.S.C. 154(b) by 97 days.

(21) Appl. No.: 10/428,941

(22) Filed: May 5, 2003

(65) Prior Publication Data

US 2004/0245715 A1 Dec. 9, 2004

(51) Int. Cl.[7] ..... B65H 5/06
(52) U.S. Cl. ..... 271/274
(58) Field of Search ..... 271/124, 274; 267/195, 214, 210, 228, 229, 29

(56) References Cited

U.S. PATENT DOCUMENTS 2,150,435 A * 9/1939 Floreth ..... 16/76
3,756,589 A * 9/1973 Carbine ..... 271/274
4,061,332 A * 12/1977 Baumgartel et al. ..... 271/270
4,605,218 A * 8/1986 Knepper et al. ..... 271/238
4,763,575 A * 8/1988 Miciukiewicz ..... 101/91
4,786,193 A * 11/1988 Quinn, Jr. ..... 400/636.3
4,852,868 A * 8/1989 Fukui et al. ..... 271/122
4,903,954 A * 2/1990 Robertson et al. ..... 271/7
4,997,179 A * 3/1991 Mizutani et al. ..... 271/306
5,141,344 A * 8/1992 Murakami et al. ..... 215/334
5,203,553 A * 4/1993 Chiang ..... 271/3.18
5,265,857 A * 11/1993 Chiang ..... 271/10.13
5,540,423 A * 7/1996 Nakano ..... 271/10.12
5,624,197 A * 4/1997 Morikawa et al. ..... 400/629
5,988,635 A * 11/1999 Ohshima ..... 271/274
6,019,366 A * 2/2000 Tranquilla ..... 271/274
6,102,388 A * 8/2000 Thornhill ..... 271/119
6,585,253 B1 * 7/2003 Miki ..... 271/125
6,648,328 B2 * 11/2003 Sugimoto ..... 271/273

FOREIGN PATENT DOCUMENTS

JP 06064774 A * 3/1994 ..... B65H 05/06

* cited by examiner

*Primary Examiner*—Donald P. Walsh
*Assistant Examiner*—Matthew J. Kohner
(74) *Attorney, Agent, or Firm*—Birch,Stewart,Kolasch,& Birch,LLP

(57) ABSTRACT

A positioning structure of a roller adapted for auto document feed apparatus includes a flexible shaft and a flexible arm. The flexible arm has a first portion integrally formed with the flexible shaft, a second portion arranged into a clamping portion of auto document feed apparatus, and a third portion formed between the first portion and the second portion. Therefore, the positioning structure can reduce higher manufacturing cost and tedious processes and indirectly decrease longer fabrication and maintainability time.

4 Claims, 9 Drawing Sheets

POSITIONING STRUCTURE OF ROLLER ADAPTED FOR AN AUTO DOCUMENT FEED APPARATUS

BACKGROUND OF THE INVENTION

1. Field of the Invention

The present invention relates to a positioning structure of a roller, and in particular to a positioning structure of a roller for use in an auto document feed apparatus that can provide a driven roller for being securely contacted with an active roller.

2. Description of the Prior Art

Please refer to the FIG. 1 and FIG. 2, a positioning structure of a roller adapted for auto document feed apparatus according to the prior art is shown as reference number 1, which is arranged in such as a printer, an auto document feed and fax machine, etc. A support portion 11 is arranged on a plastic plate (not shown) of the auto document feed apparatus. The support portion 11 has an opening 12. A metal rod 13 is passed through the opening 12 and arranged on the support portion 11. A driven roller 14 is sleeved on the metal rod 13, for contacting an active roller (not shown). A spring 15 is positioned in the opening 12 under the metal rod 13, to against the metal rod 13.

FIG. 3 and FIG. 4 show another embodiment of the prior art, a positioning structure of a roller adapted for auto document feed apparatus according to the prior art is shown as reference number 2. A support portion 21 is arranged on a plastic plate (not shown) of the auto document feed apparatus. The support portion 21 has an opening 22. A metal rod 23 is passed through the opening 22 and arranged on the support portion 21. A driven roller 24 is sleeved on the metal rod 23, for contacting an active roller (not shown). A screw 26 locked a spring band 25 on the plastic plate (not shown) to deliver paper.

However, due to some manufacture technology limitations and the consideration of manufacturing cost, the positioning structure of roller adapted for auto document feed apparatus can not be easily fabricated and maintained. Therefore, the manufacturing cost will be increased.

In addition, the conventional positioning structure of a roller adapted for auto document feed apparatus is unfavorable to repair, replace and maintain. Furthermore, the manufacturing cost and the difficulty of fabrication are high, too.

Further, in accordance with the Mechanical Engineering, when a force is pressured on a non-uniform shaft or a different element on the shaft, a torque or a bending moment will be generated. Therefore, it would cause the angular velocity to be different between the driven roller and the active roller, make the paper block up, and even deform or break the shaft.

Accordingly, the positioning structure of a roller adapted for auto document feed apparatus known in the prior art is non-convenient when used.

Therefore, the present invention is directed to an improved positioning structure of a roller adapted for auto document feed apparatus having a reasonable design and lower manufactured cost thereon.

SUMMARY OF THE DISCLOSURE

It is an object of the present invention to provide a positioning structure of a roller adapted for auto document feed apparatus, which is integrally formed by a flexible arm and a flexible shaft, to decrease the manufactured cost and production.

It is another object of the present invention to provide a positioning structure of a roller adapted for auto document feed apparatus, to achieve the roller positioning and the function of delivering paper with more simplistic, and to further correspond to the micro scale trend.

In order to achieve the above objectives of the invention that provides a positioning structure of roller adapted for an auto document feed apparatus having a transmission shaft, an active roller is sleeved on the transmission shaft, and a driven roller is rotationally contacted with the active roller; the positioning structure of the roller comprises a flexible shaft pivotally contacted with the driven roller of the auto document feed apparatus; and a flexible arm has a first portion integrally formed with the flexible shaft, a second portion fixedly arranged on a clamping portion of the auto document feed apparatus, and a third portion formed between the first portion and the second portion, for providing a reaction force against the active roller.

From the present invention, the flexible shaft is pivotally contacted with the driven roller of the auto document feed apparatus, and the second portion of the flexible arm is fixedly arranged on the clamping portion of the auto document feed apparatus, to cause the driven roller to be closely fastened to the active roller of the auto document feed apparatus via elasticity from the third portion of the flexible arm.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTIONS OF THE DRAWINGS

The present invention will become more fully understood from the detailed description given hereinbelow and the accompanying drawings which are given by way of illustration only, and thus are not limitative of the present invention, and wherein:—

DETAILED DESCRIPTION OF THE PREFERRED EMBODIMENTS

Figure 1:
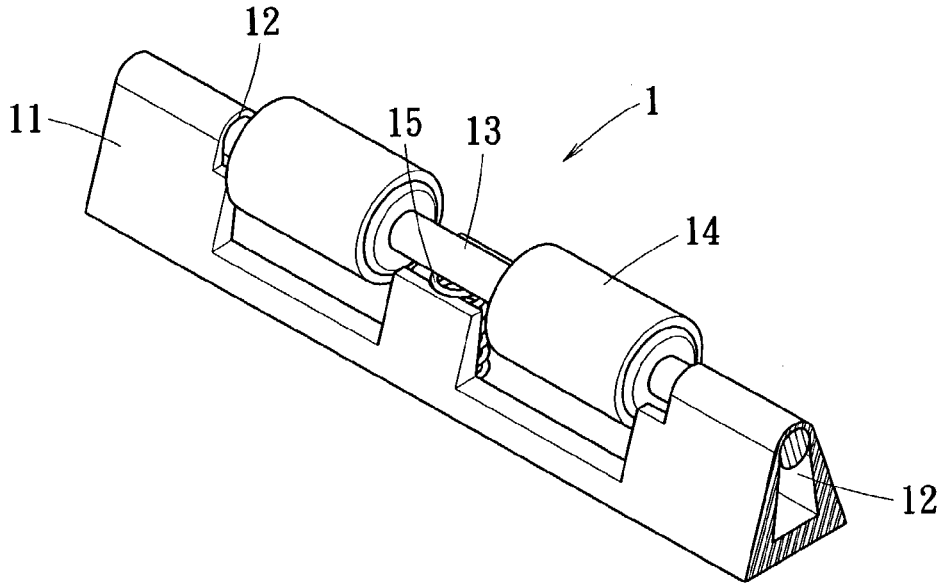
FIG. 1 PRIOR ART
FIG. 1 is a perspective view of a conventional positioning structure of roller adapted for auto document feed apparatus.
Figure 2:
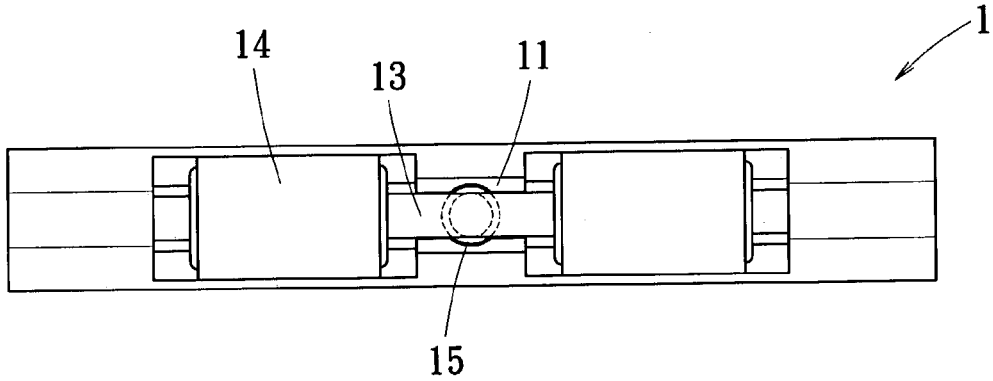
FIG. 2 PRIOR ART
FIG. 2 is a schematic top view of FIG. 1.
Figure 3:
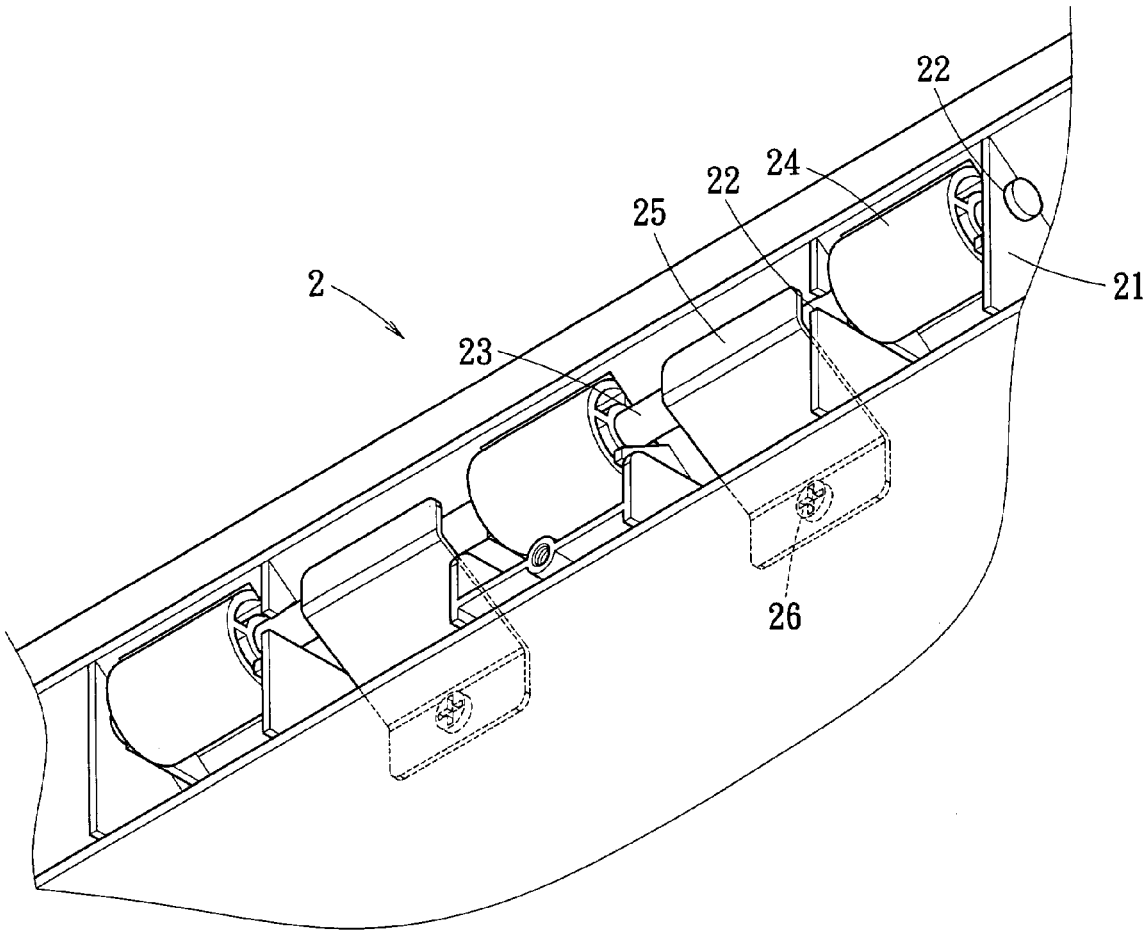
FIG. 3 PRIOR ART
FIG. 3 is a perspective view of a conventional positioning structure of a roller adapted for auto document feed apparatus.
Figure 4:
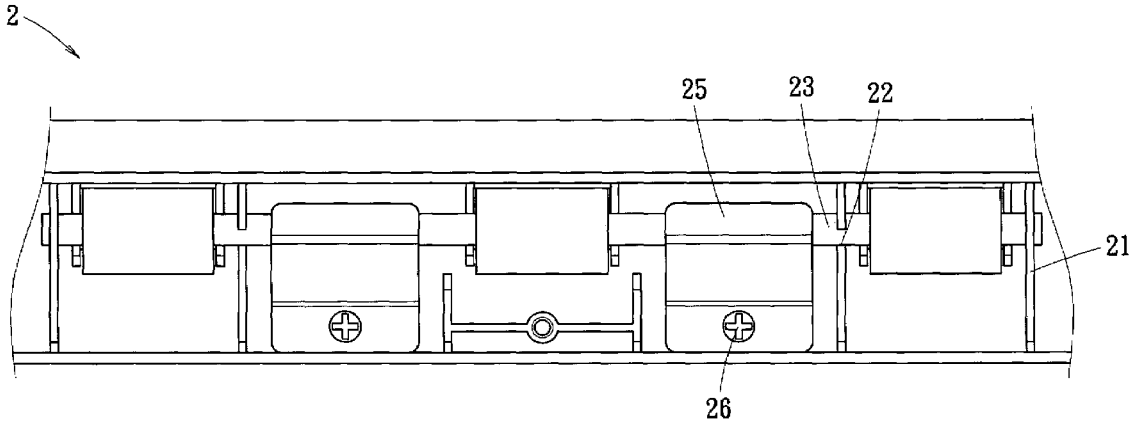
FIG. 4 PRIOR ART
FIG. 4 is a schematic top view of FIG. 3.
Figure 5:
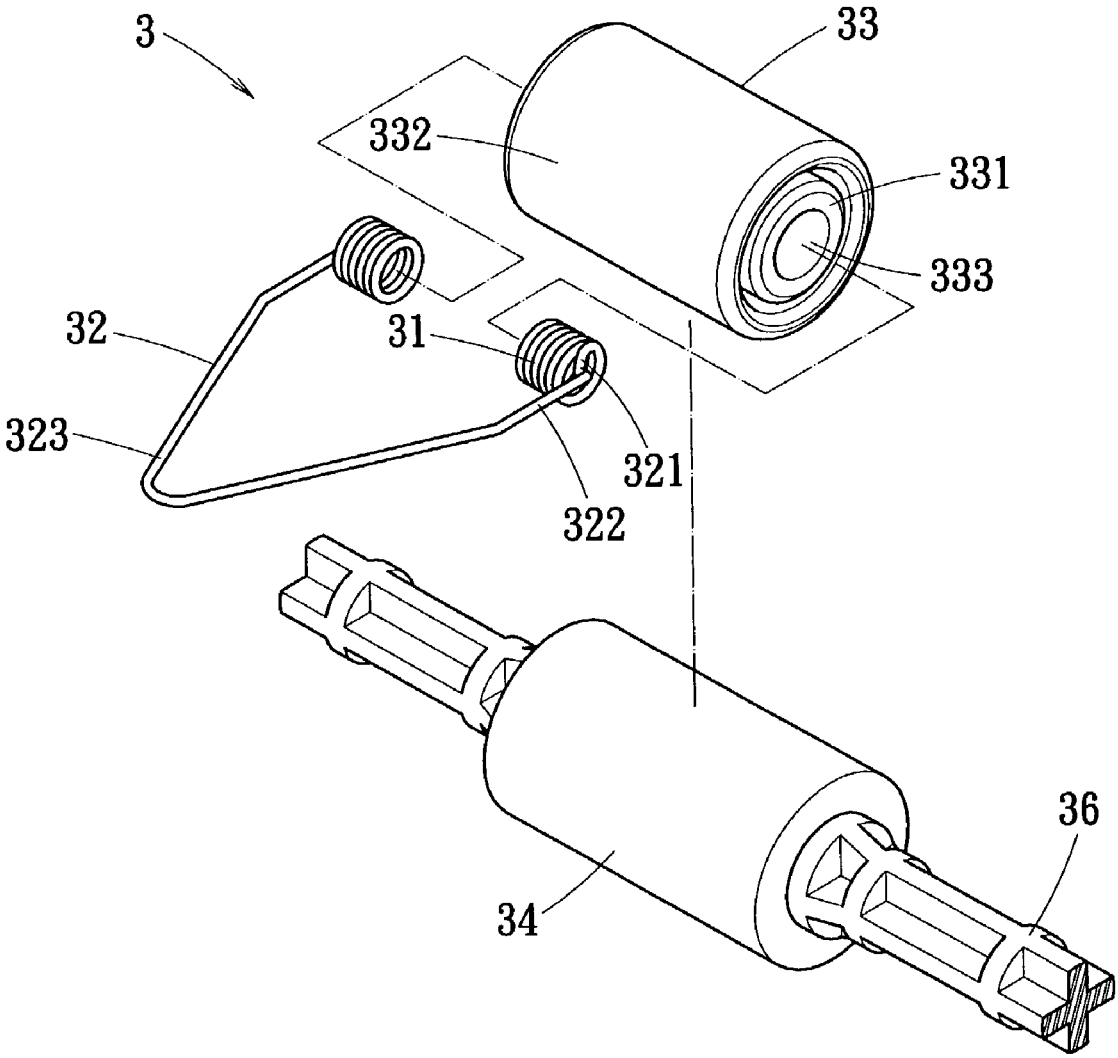
FIG. 5 is an exploded view of the positioning structure of a roller according to the present invention.
Figure 6:
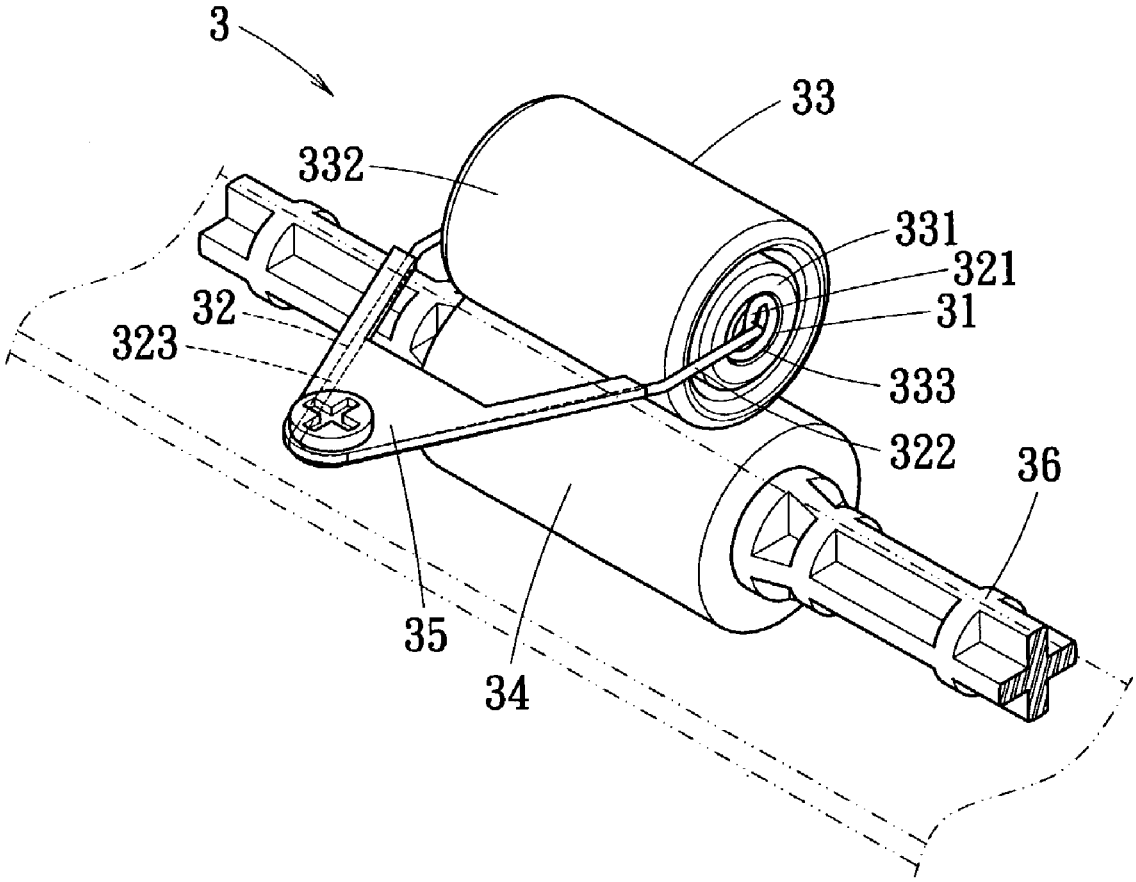
FIG. 6 is a perspective view of the positioning structure of a roller according to the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Although the embodiments of the present invention are described below in connection with a positioning structure of roller adapted for auto document feed apparatus, the present invention can be applied to all auto document feed apparatus, including but not limited to multi-function peripherals, printers, copiers, fax machines, as well as all other auto document feed apparatus and feed paper machines.

FIGS. 5–8 illustrate a positioning structure of a roller adapted for auto document feed apparatus, wherein the auto document feed apparatus has a transmission shaft 36, an active roller 34 is bushed on the transmission shaft 36, and a driven roller 33 is rotationally contacted with the active roller 34.

The positioning structure of the roller has a flexible shaft 31; and a flexible arm 32 is integrally formed with the flexible shaft 31, and a clamping portion 35 of the auto document feed apparatus clamps the flexible arm 32 therein. The flexible shaft 31 is made of steel having a spring shape, and the flexible shaft 31 spirally extends along an axial line of the flexible shaft 31. The driven roller 33 includes a plastic roller 331 and a rubber surface 332, the rubber surface 332 sticks on the plastic roller 331, and an opening 333 is formed on each side of the plastic roller 331. The opening 333 of the plastic roller 331 is to accommodate the flexible shaft 31 and to cause that the driven roller 33 rotationally contacts the active roller 34. The flexible shaft 31 is pivotally contacted with the opening 333 of the plastic roller 331.

The flexible arm 32 is made of steel and having elasticity, the flexible arm 32 has a first portion 321, and the first portion 321 is integrally formed with the flexible shaft 31. A second portion 323 of the flexible arm 32 is a curve shape, for being mounted inside the clamping portion 35. A third portion 322 of the flexible arm 32 is integrally formed between the first portion 321 and the second portion 323. Therefore, using the second portion 323 of flexible arm 32 mounted on the clamping portion 35 while the active roller 34 pressures a force on the driven roller 33, the third portion 322 of the flexible arm 32 provides a reaction force to the first portion 321 of the flexible arm 32. The clamping portion 35 fixedly clamps the second portion 323 of the flexible arm 32 in a desired space, and a suitable angle is provided in the second portion 323, for the convenience to fabricate, repair and maintain the driven roller 33 at a later time.

Figure 7:
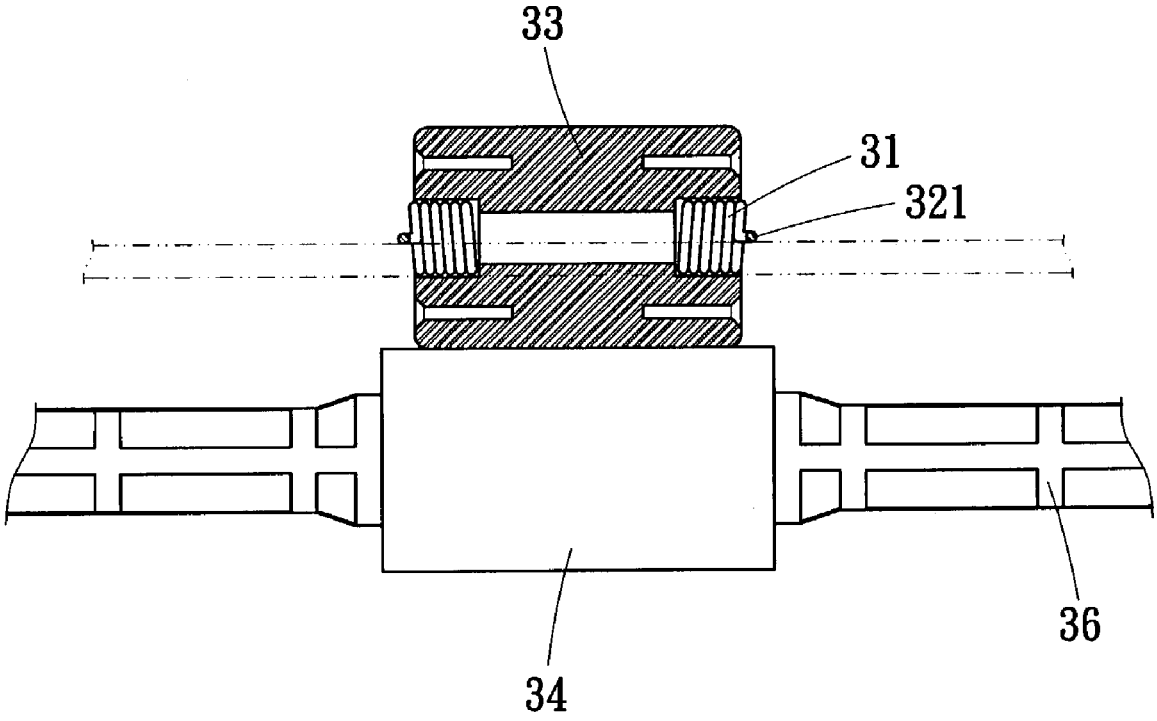
FIG. 7 is a partial cross-sectional view of the positioning structure of a roller according to the present invention, which appears the flexible shaft pivotally contacted with the opening of plastic roller and integrally formed with the first portion of the flexible arm.
Figure 8:
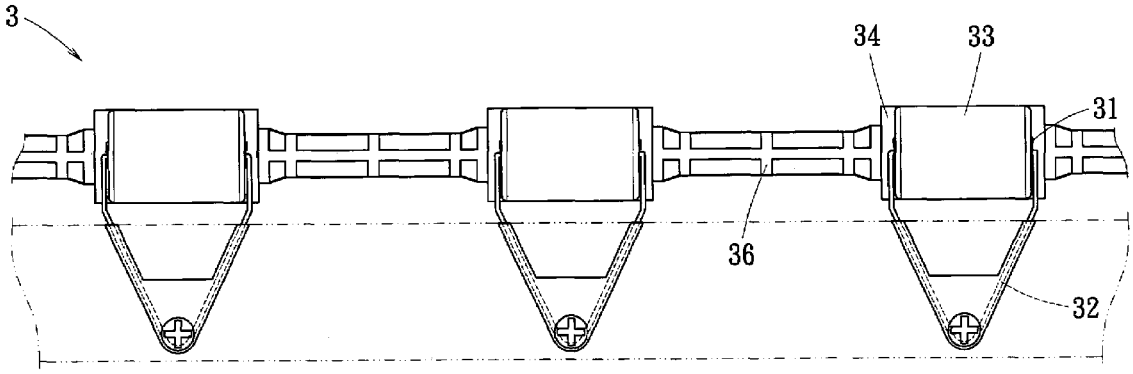
FIG. 8 is a perspective view of the positioning structure of a roller according to the present invention, which is arranged a row and acted on the active roller with each other.

FIG. 7 shows a partial cross-sectional view of the positioning structure of the roller according to the present invention. As shown in FIG. 7, the flexible shaft 31 is mounted in the opening 333 of the plastic roller 331, and is pivotally contacted with the plastic roller 331 therein. The first portion 321 of the flexible arm 32 is integrally formed with the flexible shaft 31.

Figure 9:
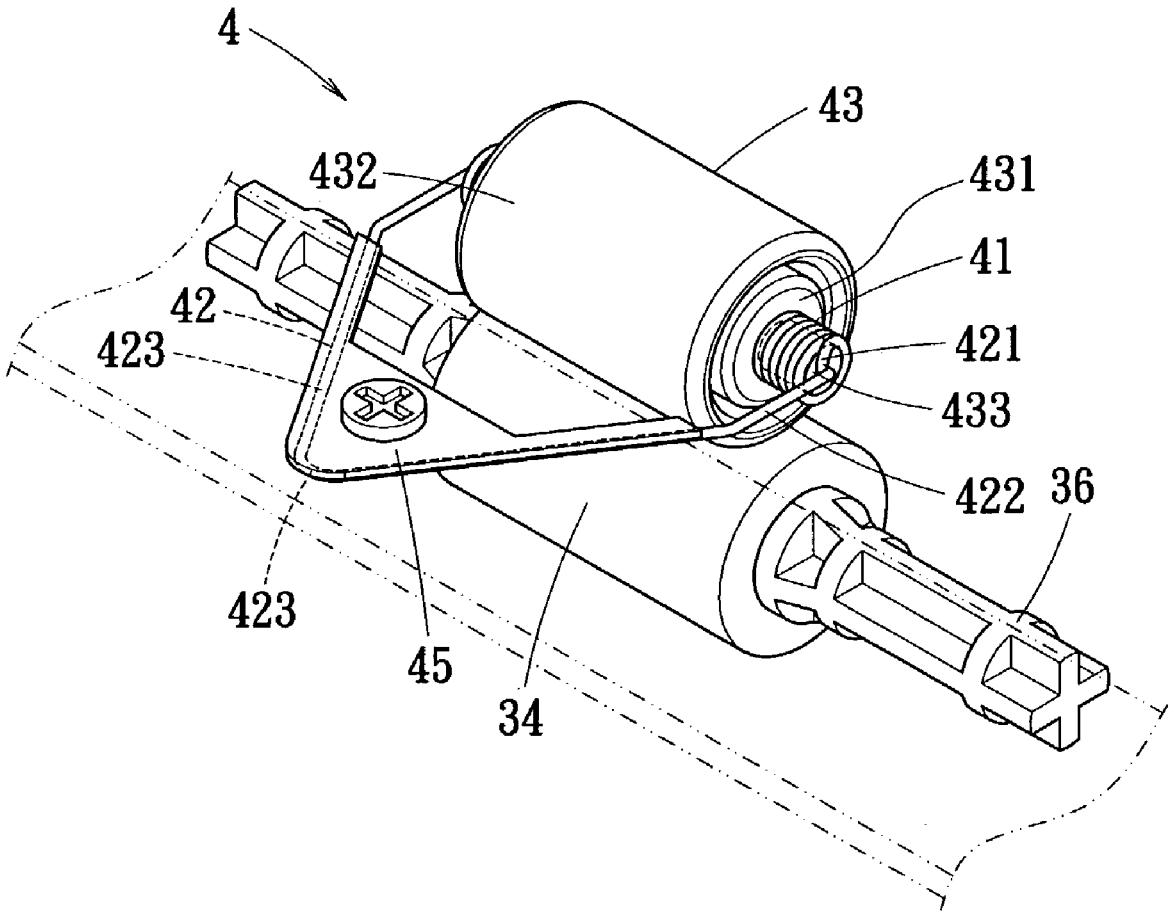
FIG. 9 is a perspective view of another embodiment according to the present invention.
Figure 10:
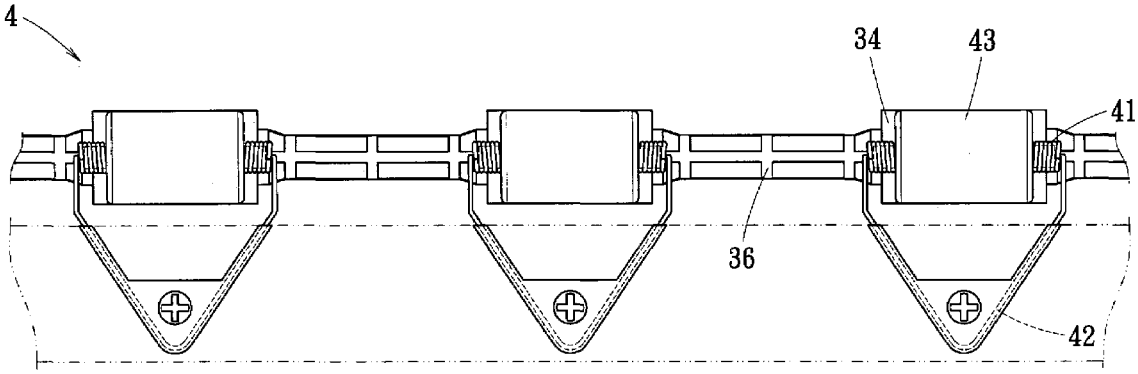
FIG. 10 is a perspective view of another embodiment according to the present invention, which is arranged a row and acted on the active roller with each other.

FIGS. 9 and 10 illustrate a positioning structure of a roller adapted for auto document feed apparatus, wherein the auto document feed apparatus has a transmission shaft 36, an active roller 34 sleeved on the transmission shaft 36, and a driven roller 43 rotationally contacted with the active roller 34. The positioning structure of roller has a flexible shaft 41; a flexible arm 42 integrally formed with the flexible shaft 41, and a clamping portion 45 of the auto document feed apparatus clamping the flexible arm 42 therein. The flexible shaft 41 is made of steel having a spring shape, and spirally extends along an axial line of the flexible shaft 41. The driven roller 43 includes a plastic roller 431 and a rubber surface 432; the rubber surface 432 sticks on the plastic roller 431, and an flange 433 is formed on each side of the plastic roller 431. The flange 433 of the plastic roller 431 is to accommodate the flexible shaft 41, to cause the driven roller 43 rotationally contact the active roller 34. The flexible shaft 41 is pivotally contacted with the flange 433 of the plastic roller 431.

The flexible arm 42 is made of steel and has elasticity. The flexible arm 42 has a first portion 421, and the first portion 421 is integrally formed with the flexible shaft 41. A second portion 423 of the flexible arm 42 is a curve shape, for being mounted inside the clamping portion 45. A third portion 422 of the flexible arm 42 is integrally formed between the first portion 421 and the second portion 423. Therefore, using the second portion 423 of flexible arm 42 mounted inside the clamping portion 45 while the active roller 34 pressures a force on the driven roller 43, the third portion 422 of the flexible arm 42 provides a reaction force to the first portion 421 of the flexible arm 42. The clamping portion 45 fixedly clamps the second portion 423 of the flexible arm 42 in a desired space, and a suitable angle is provided in the second portion 423, for the convenience to fabricate, repair and maintain the driven roller 43 at a later date.

A prototype of positioning structure of a roller adapted for auto document feed apparatus has been constructed herein with features as described above. The present invention by means of the manufacture of a mechanical process formed in unity, decreases the manufacturing cost and time of fabrication substantially, and by means of the elastic property of material and the different shape design of clamping portion of the auto document feed apparatus, increases the convenience for use, fabrication and repair. Based on Von Mises-Hencky theorem we can get more ability of the anti-stress and anti-strain than the conventional metal rod or plastic rod. In addition, the present invention eliminates more structures and elements of the auto document feed apparatus than the prior art, and gets the best function of delivering paper. In addition, collocating the different shape design of clamping portion of the auto document feed apparatus also can save more space. Therefore, the present invention improves the known positioning structure of roller adapted for auto document feed apparatus in prior art that cannot effectively decrease higher manufacturing cost and longer time of fabrication and maintainability. Moreover, the present invention also reduces the volume of positioning structure of roller substantially.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A positioning structure of a roller adapted for an auto document feed apparatus having a transmission shaft, an active roller sleeved on the transmission shaft and a driven roller rotationally contacted with the active roller; the positioning structure comprising:

two flexible shafts pivotally contacted with the driven roller of the auto document feed apparatus, each of the two flexible shafts being a spring spirally extending along an axial line thereof; and a flexible arm, the flexible arm including two first portions, a second portion, and two third portions, the two first portions respectively extending from the two flexible shafts, the second portion being fixedly arranged inside a clamping portion of the auto document feed apparatus, the second portion having a curved shape with an acute angle and having two ends, the two third portions respectively extending from the two ends of the second portion to the two first portions to provide a reaction force against the active roller.

2. The positioning structure of a roller as claimed in claim 1, wherein each of the two flexible shafts is pivotally contacted within an opening of the driven roller.

3. The positioning structure of a roller as claimed in claim 1, wherein each of the two flexible shafts is pivotally contacted around a flange of the driven roller.

4. The positioning structure of a roller as claimed in claim 1, wherein the second portion of the flexible arm has a V shape, for being inserted and secured in the clamping portion.

* * * * *